US006417774B1

(12) United States Patent
Hibbs et al.

(10) Patent No.: US 6,417,774 B1
(45) **Date of Patent: *Jul. 9, 2002**

(54) SYSTEM AND METHOD FOR IDENTIFYING UNSAFE TEMPERATURE CONDITIONS

(75) Inventors: James D. Hibbs, Smithville; John W. Brodhecker, Leander, both of TX (US)

(73) Assignee: Fireeye Development Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/595,321

(22) Filed: Jun. 16, 2000

Related U.S. Application Data

(63) Continuation-in-part of application No. 09/182,823, filed on Oct. 29, 1998, now Pat. No. 6,118,382.

(60) Provisional application No. 60/064,324, filed on Oct. 30, 1997.

(51) Int. Cl.[7] ..... G08B 17/00

(52) U.S. Cl. ..... 340/584; 340/586

(58) Field of Search ..... 340/586, 584, 340/583, 589, 693.1, 693.3, 693.4, 636, 693.5, 693.6, 632; 128/201.27, 202.22, 203.17, 205.23

(56) References Cited

U.S. PATENT DOCUMENTS

| | | | | | |
|---|---|---|---|---|---|
| 3,201,771 | A | * | 8/1965 | Proulx | 340/586 |
| 4,709,202 | A | * | 11/1987 | Koenck et al. | 320/112 |
| 4,727,359 | A | * | 2/1988 | Yuchi et al. | 340/518 |
| 4,996,981 | A | | 3/1991 | Elenewski et al. | 128/201.15 |
| 5,157,378 | A | | 10/1992 | Stumberg et al. | 340/521 |
| 5,200,736 | A | * | 4/1993 | Coombs et al. | 340/586 |
| 5,283,549 | A | * | 2/1994 | Mehaffey et al. | 340/521 |
| 5,301,668 | A | | 4/1994 | Hales | 128/205.23 |
| 5,398,023 | A | * | 3/1995 | Murray | 340/7.63 |
| 5,428,964 | A | * | 7/1995 | Lobdell | 62/176.6 |
| 5,483,229 | A | * | 1/1996 | Tamura et al. | 340/691.7 |
| 5,541,579 | A | | 7/1996 | Kiernan | 340/573.1 |
| 5,558,084 | A | * | 9/1996 | Daniell et al. | 128/203.17 |
| 5,635,909 | A | | 6/1997 | Cole | 340/586 |
| 5,640,148 | A | | 6/1997 | Lewis et al. | 340/573.1 |
| 5,659,296 | A | | 8/1997 | Debe et al. | 340/632 |
| 5,689,234 | A | * | 11/1997 | Stumberg et al. | 340/521 |
| 5,691,707 | A | | 11/1997 | Smith | 340/682 |
| 5,781,118 | A | | 7/1998 | Wise et al. | 340/632 |
| 5,917,416 | A | | 6/1999 | Read | 340/584 |
| 5,973,602 | A | | 10/1999 | Cole, III et al. | 340/584 |
| 6,075,445 | A | * | 6/2000 | McLoughlin et al. | 340/586 |
| 6,084,522 | A | * | 7/2000 | Addy | 340/630 |
| 6,091,331 | A | * | 7/2000 | Toft et al. | 340/539 |
| 6,118,382 | A | * | 9/2000 | Hibbs et al. | 340/586 |

* cited by examiner

*Primary Examiner*—Van Trieu
(74) *Attorney, Agent, or Firm*—Baker Botts L.L.P.

(57) ABSTRACT

A system and method are disclosed for alerting safety personnel of unsafe air temperature conditions. The system includes a removable safety system operable to be coupled to safety personnel for detecting ambient temperature conditions is provided. The system further includes a control unit operable to be coupled to the safety personnel having electronics operable to communicate signals associated with the ambient air condition. The system further includes a sensor unit operable to be positioned with an ambient environment and coupled to a substantially centered position of a viewmask. The sensor unit includes a temperature sensor having an temperature dependent operating mode communicatively coupled to the control unit and a first indicator and second indicator operable to display an indication representing an ambient air temperature condition.

12 Claims, 10 Drawing Sheets

FIG. 10A
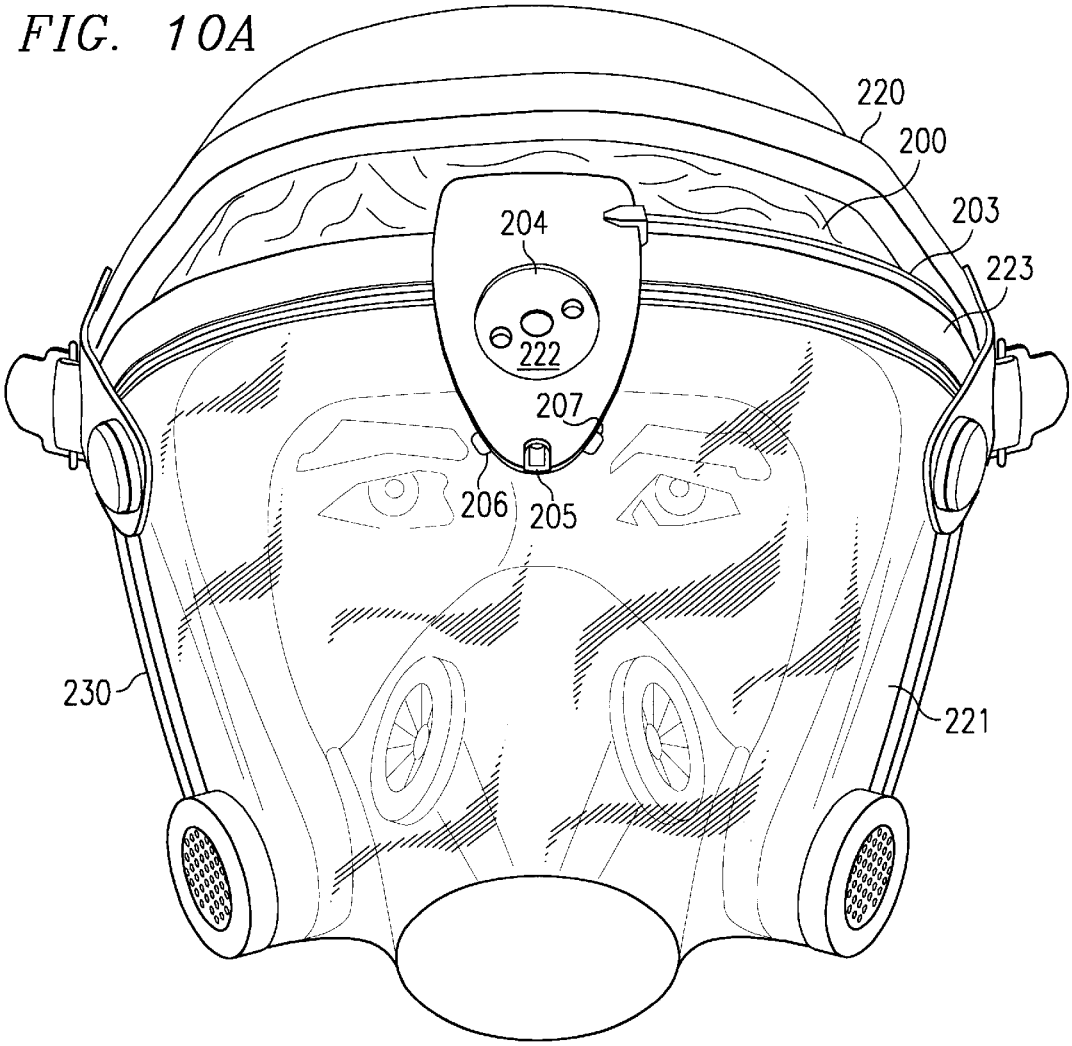
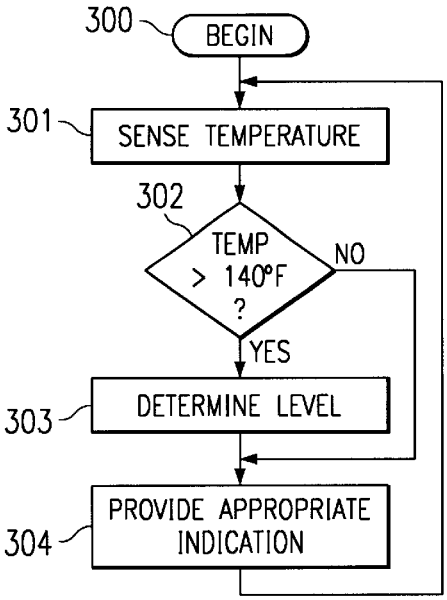
FIG. 11

SYSTEM AND METHOD FOR IDENTIFYING UNSAFE TEMPERATURE CONDITIONS

CROSS-REFERENCE TO RELATED APPLICATIONS

This application is a continuation-in-part with respect to co-pending U.S. application Ser. 09/182,823, filed Oct. 29, 1998 entitled, System and Method for Alerting Safety Personnel of Unsafe Air Temperature Conditions now U.S. Pat. No. 6,118,382.

This application claims priority under 35 U.S.C. § 119(e) of provisional application No. 60/064,324, filed Oct. 30, 1997.

TECHNICAL FIELD OF THE INVENTION

The present invention relates in general to the field of equipment for firefighters and other safety personnel, and, more particularly, to a system and method for alerting safety personnel of unsafe air temperature conditions.

BACKGROUND OF THE INVENTION

Firefighters and other safety personnel use various types of equipment when fighting a fire. This equipment typically includes a coat, boots, gloves and other clothing specially created to protect against fire and heat as well as a self contained breathing apparatus to provide oxygen. Although such equipment provides some protection, firefighter's still face significant dangers including the danger of a flashover. In general, once the ambient temperature in a fire reaches about 600 degrees Fahrenheit, the temperature will quickly rise to over 1100 degrees Fahrenheit. At this point, a flashover can occur in which the air ignites and kills or severely injures firefighters. Thus, it is unsafe to fight fires once the ambient temperature reaches around 600 degrees Fahrenheit.

To alleviate some of the dangers involved in firefighting, various electronic devices have been developed to provide warnings to firefighters. For example, U.S. Pat. No. 5,640,148 discloses a dual activation alarm system for a personal alert safety system (PASS). U.S. Pat. No. 5,635,909 discloses a temperature monitoring assembly that is incorporated into a garment such as a coat. This device includes a speaker to provide an audible alarm. U.S. Pat. No. 5,541,549 discloses a personal alarm safety system that is designed as part of the firefighter's belt. Further, U.S. Pat. No. 5,137,378 discloses an integrated firefighter safety monitoring and alarm system that provides a number of warnings to a firefighter. This system includes temperature monitoring and provides an audible alarm. The system also has a display for providing additional information to the firefighter including a visible warning. The system is contained in a case that can have a belt or mounting clip for attaching to the firefighter's equipment.

However, even with such conventional devices, firefighters are still injured or killed by flashovers. The complexity of the conventional devices, the difficulties of the firefighting environment and the type and location of the warnings cause firefighters not to hear audible warnings or not to see visible warnings of dangerous ambient temperatures.

SUMMARY OF THE INVENTION

In accordance with the present invention, a system and method for alerting safety personnel of unsafe air temperature conditions are disclosed that provide advantages over previously developed temperature warning equipment.

According to one aspect of the present invention, a system for alerting safety personnel of ambient air temperature conditions is provided. The system includes a control unit stored within a housing wherein the control unit includes electronics operable to communicate a signal associated with an ambient air temperature condition. The system also includes a sensor unit communicatively coupled to the control unit wherein the sensor unit operable to be positioned within an ambient environment at a distance from the control unit. The sensor unit includes a temperature sensor operable to sense an ambient air temperature and an indicator operable to provide an indication representing the ambient air temperature condition.

According to another aspect of the present invention, a method for operating a safety device for displaying ambient air temperature conditions to safety personnel is provided. The method includes sensing an ambient air temperature using a temperature sensing device and determining a mode of operation associated with the device in response to the sensed temperature.

According to a further aspect of the present invention, a removable safety system operable to be coupled to safety personnel for detecting ambient temperature conditions is provided. The system includes a control unit operable to be coupled to the safety personnel having electronics operable to communicate signals associated with the ambient air condition. The system further includes a sensor unit operable to be positioned with an ambient environment and coupled to a substantially centered position of a viewmask. The sensor unit includes a temperature sensor having an temperature dependent operating mode communicatively coupled to the control unit and a first indicator and second indicator operable to display an indication representing an ambient air temperature condition.

A technical advantage of the present invention is the providing of indicators and/or alarms to safety personnel focused upon the personal safety of the firefighter. The trigger points, rather than being focused on equipment safety, focus upon the safety personnel.

Another technical advantage of the present invention is the ease of use in that the temperature indicators are positioned within the personnel's peripheral vision near the face mask of a self contained breathing apparatus. The present invention can help save lives by providing a passively visible warning that the environment is approaching flashover conditions. Further, the present invention may save on taxpayer's funds that would have otherwise been spent on fire suit replacements, compensation packages and downtime costs.

A further technical advantage of the present invention is providing a system having an operating mode dependent on an ambient air temperature conditions and system operating availability.

Another technical advantage of the present invention is providing a removable safety system which may be coupled to conventional firefighting equipment such as face shields, helmets, mask webbings and the like.

Additional technical advantages should be readily apparent from the drawings, description, and claims.

BRIEF DESCRIPTION OF THE DRAWINGS

A more complete understanding of the present invention and advantages thereof may be acquired by referring to the following description taken in conjunction with the accompanying drawings in which like reference numbers indicate like features and wherein:

FIG. 10A is a front perspective view of the system of FIG. 7 coupled to a self contained breathing apparatus face piece according to one embodiment of the present invention;

FIG. 11 is a flow chart of a method for alerting safety personnel of unsafe air temperature conditions according to another embodiment of the present invention;

DETAILED DESCRIPTION OF THE INVENTION

Figure 1:
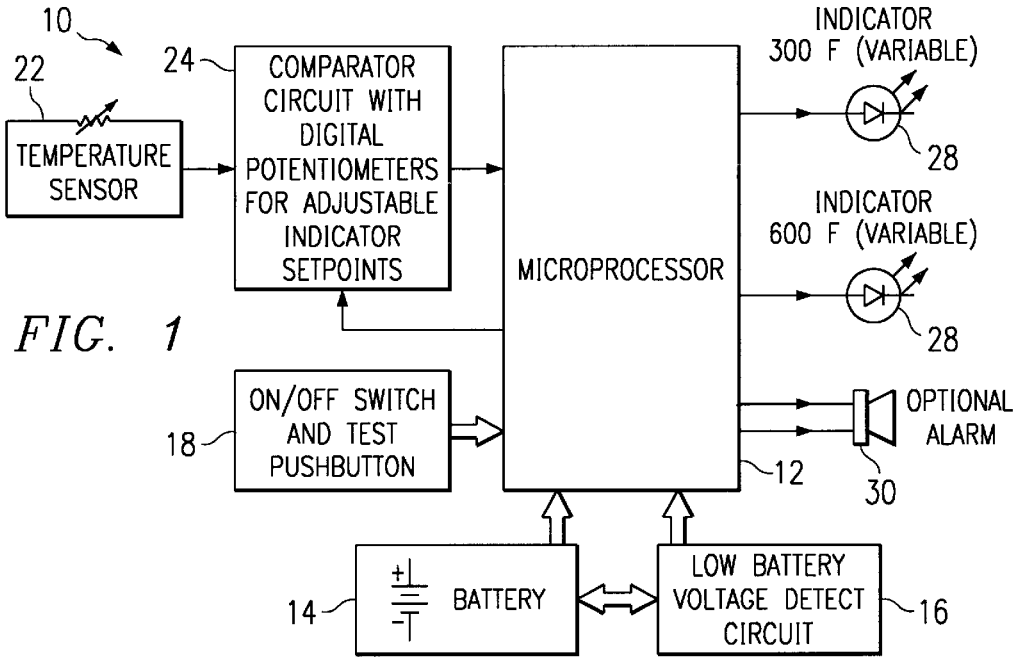
FIG. 1 is a block diagram of one embodiment of a system for alerting safety personnel of unsafe air temperature conditions according to the present invention.

FIG. 1 is a block diagram of one embodiment of a system, indicated generally at 10, for alerting safety personnel of unsafe air temperature conditions according to the present invention. As shown, system 10 has a microprocessor 12 that receives power from a battery 14. Microprocessor 12 serves as a control unit for system 10, which control unit, it should be understood, could comprise other types of control devices. Battery 14 can be replaced by the user and can be conserved by switching system 10 off when not in use. System 10 also includes a low battery voltage detect circuit 16 and can be turned on and off by an on/off switch 18 and test push-button 18. This switch 18 can be backed up by an automatic switch (not shown) that turns system 10 on when the ambient temperature reaches a certain point, such as is 150 degrees Fahrenheit.

A temperature sensor 22 measures temperature and provides an output to a comparator circuit 24 which has digital potentiometers for adjustable indicator set points. Temperature sensor 22 can, for example, be a resistive temperature device (RTD), thermocouple, thermistor or infra-red (IR) sensor. In the embodiment of FIG. 1, system 10 has dual thresholds, but it should be understood that more thresholds could be implemented if appropriate. Also, in the embodiment of FIG. 1, digital potentiometers can be set by signals from microprocessor 12.

In operation, comparator circuit 24 provides a signal to microprocessor 12 in response to a comparison between the digital potentiometers and the output from temperature sensor 22. Microprocessor 12 then provides signals to drive two visible indicators 28, as shown. These visible indicators 28 can, for example, be LED, LCD, heads-up-display, fiber optic or incandescent indicators. In the illustrated embodiment, visible indicators 28 indicate an ambient temperature of 300 degrees Fahrenheit and 600 degrees Fahrenheit, respectively. However, these settings are variable and could be other values. Further microprocessor 12 can provide signals to an optional alarm 30. The alarm can, for example, be an audible or vibration alarm.

The microprocessor control of system 10 can provide additional enhancements to temperature monitoring for the safety of safety personnel. For example, system 10 can utilize time averaged measurements for additional or alternate indicators. Such time averaged measurements identify the fact that the safety personnel has been at a given ambient temperature for a given amount of time. Examples of time averaged measurements include: 160 degrees Fahrenheit for 60 seconds, 180 degrees Fahrenheit for 30 seconds, 212 degrees Fahrenheit for 15 seconds, and 500 degrees Fahrenheit for 60 seconds. System 10 can react to such events by providing additional visible indicators and alarms. Another enhanced feature is an ability to record and provide a temperature history for a post-event analysis. For example, the temperature could be recorded at specified intervals of time while the firefighter or other safety personnel is working to give an idea of the temperature profile within the site. Further, this could be linked with positioning information, such as from GPS equipment, to "map" the temperature gradients within the site. The recording can, for example, be into on-board random access memory.

One purpose of system 10 is to provide firefighter and other safety personnel with an early warning of excessive temperatures that would eventually lead to a flashover or other danger. In general, once the ambient temperature in a fire reaches 300 degrees Fahrenheit, the temperature will start rising, and it takes around 2 minutes, linearly, to reach 600 degrees Fahrenheit. Once the temperature reaches that threshold, the temperature will start rising exponentially to over 1100 degrees Fahrenheit in less than a minute. This fatal phenomenon is termed a flashover. It is appropriate to evacuate buildings or other structures once the temperature reaches around 600 degrees Fahrenheit. Further, other temperature related conditions can be unsafe for firefighters. For example, as mentioned above, remaining in a high ambient temperature for a certain period of time can be dangerous.

In one implementation, the present invention provides a system that generally incorporates a remote temperature sensing device encapsulated with batteries and indicators (e.g., green and red indicators such as miniature incandescent lights) within an insulated enclosure which is mounted within the peripheral vision of the self-contained breathing apparatus (SCBA) that firefighters wear. The green and red indicators will glow the moment the ambient temperature rises above 300 degrees Fahrenheit or 600 degrees Fahrenheit, respectively. This early signaling will afford firefighters with ample time to react to the situation and make informed decisions as to whether to proceed or revert. Not only will the present invention save many firefighter's lives, but, in turn, will also save on taxpayer's funds that would have otherwise been spent on fire suit replacements, firefighter's compensation packages and downtime costs.

Figure 2:
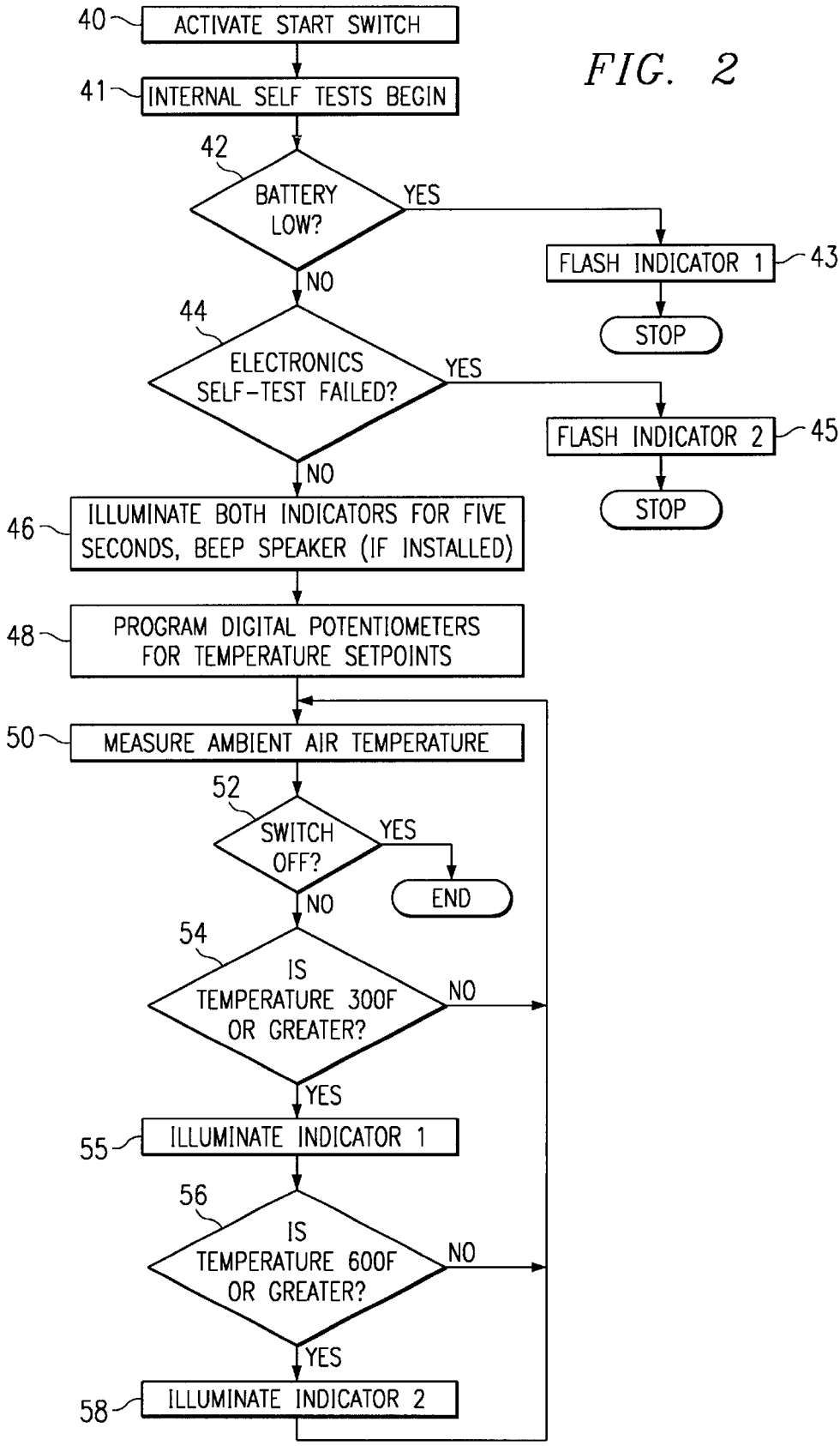
FIG. 2 is a flow chart of one embodiment of a method for alerting safety personnel of unsafe air temperature conditions according to the present invention.

FIG. 2 is a flow chart of one embodiment of a method for alerting safety personnel of unsafe air temperature conditions according to the present invention. As shown, in step 40, the start switch is activated. This activation can be manual or automatic as mentioned above. Then, in step 41, the system begins an internal self test. In step 42, the system checks whether the battery is low. If so, in step 43, the system flashes one of the indicators to signal the problem. In step 44, the system determines whether the self-test failed. If so, in step 45, the system flashes the other indicator to signal this failure. If the tests do not fail, in step 46, the system illuminates both indicators for five seconds and beeps the installed speaker (if any).

In step 48, the system then allows a user to program the digital potentiometers for the temperature set points. This can be an optional step if the digital potentiometers are already set. Then, in step 50, the system measures the ambient temperature on an ongoing basis using the temperature sensor. In step 52, the system determines it is switched off. If so, then the process stops. Otherwise, the system checks, in step 54, whether the temperature is at the first set point (e.g., 300 degrees Fahrenheit) or greater. If not, then the system returns to measuring the temperature. If the temperature is greater than 300 degrees Fahrenheit, then the system illuminates the first indicator in step 55. Then, in step 56, the system checks whether the temperature is greater than the second set point (e.g., 600 degrees Fahrenheit). If not, the system returns to measuring the temperature of step 50. If the temperature is greater than 600 degrees Fahrenheit, then the system illuminates the second indicator in step 58 and then returns to measure temperature, as shown. In this manner, the system continually monitors the ambient temperature and provides a visible warning of the ambient temperature is above either of the temperature set points. It should be understood that other implementations would include other steps. For example, an implementation having time averaged measurements would involve steps for averaging temperature over a specified interval of time and alerting a firefighter or other safety personnel when certain conditions have been met.

Figure 3:
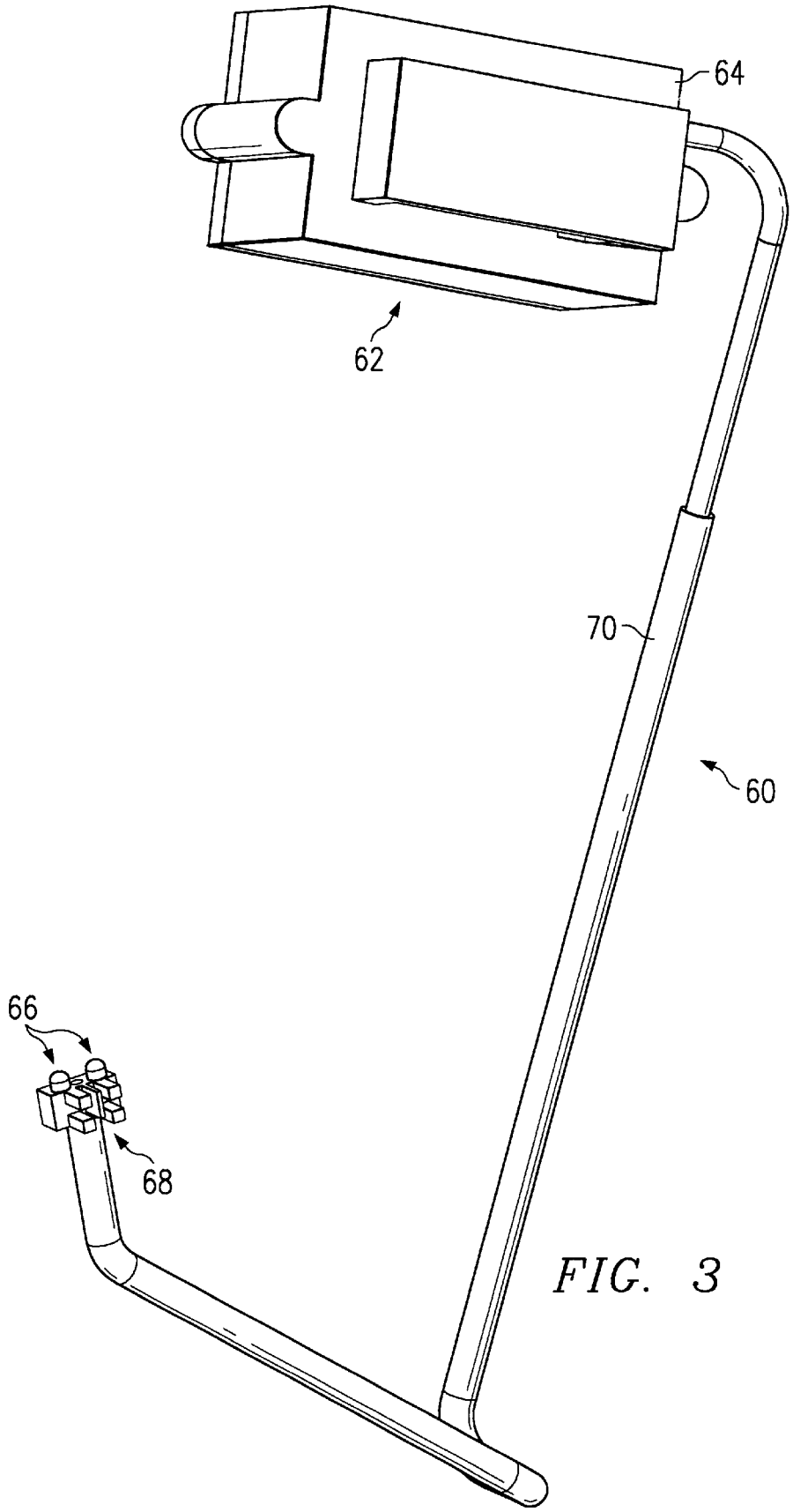
FIG. 3 is a perspective view of one embodiment of a system for alerting safety personnel of unsafe air temperature conditions constructed according to the present invention.

FIG. 3 is a perspective view of one embodiment of an system, indicated generally at 60, for alerting safety personnel of unsafe air temperature conditions constructed according to the present invention. As shown, system 60 comprises electronics 62 that are contained primarily in a housing 64 with the exception of visible indicators 66 and a sensor 68 which are positioned at the end of an arm 70 extending from housing 64. In this embodiment, sensor 68 and indicators 66 on arm 70 can be exposed to the ambient temperatures, while the remaining portions of system 60 are protected within the firefighters equipment. Further, this allows the sensor 68 and indicators 66 to be easily replaceable with a detachable arm 70. Electronics 62 can be implemented, for example, according to the block diagram of FIG. 1, above.

Figure 4:
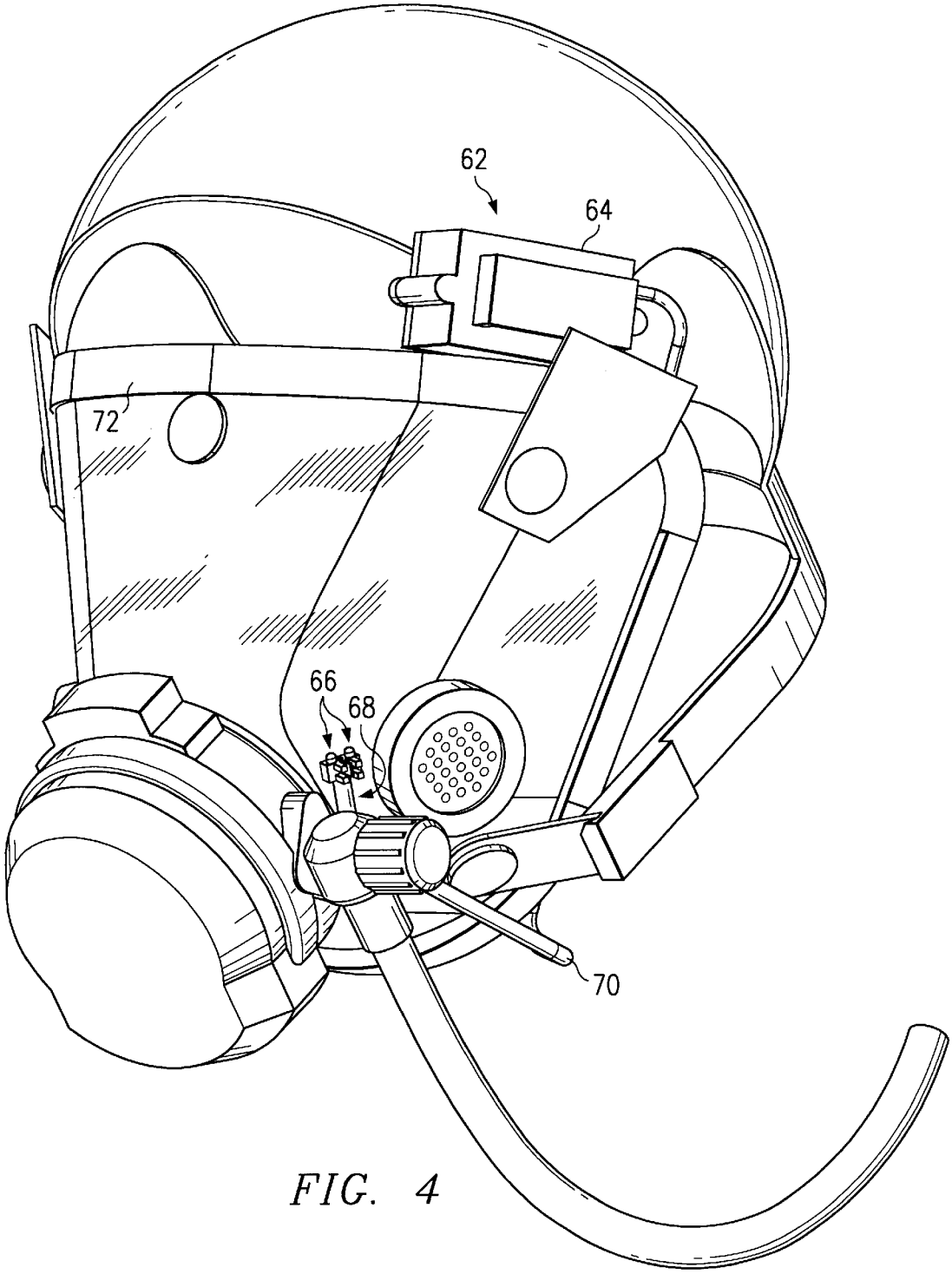
FIG. 4 is a perspective view of one embodiment of the system of FIG. 3 coupled to a self contained breathing apparatus face piece according to the present invention.

FIG. 4 is a perspective view of one embodiment of system 60 of FIG. 3 coupled to a self contained breathing apparatus face piece 72 according to the present invention. As shown, housing 64 of system 60 is attached to face piece 72 which is coupled to a firefighter's helmet. A arm 70 then extends from housing 64 and positions indicators 66 within the peripheral vision of the firefighter. In this manner, the firefighter can passively see indicators 66 without actively having to look away or otherwise take attention away from firefighting tasks.

According to the present invention, system 60 can be a completely self-contained unit attached to the firefighter's self-contained breathing apparatus (SCBA) face piece 72. System 60 operates to alert a firefighter when the ambient temperature has reached an unsafe level, for example, that would lead to a flashover. System 60 can be mounted in a fashion such that indicators 66 (e.g., LEDs, miniature incandescent lights) which turn on at pre-determined temperatures are other defined conditions, lie within the firefighter's peripheral vision.

As shown above, a switch can turn system 60 on and also can serve as a daily test button. A successful self-test can illuminate indicators 66, then turn them off and allow a speaker to beep (if present). If there is a problem with electronics 62, indicators 38 can flash an error sequence when system 60 is switched on. Also, the power switch can be backed up by an automatic switch that turns system 60 on when the ambient temperature reaches a specified point.

According to the present invention, visible indicators are placed in the field of view, for example, while a firefighter is fighting a fire. When the ambient temperature reaches a first set point (e.g., 300° F.), the first indicator will be illuminated and will stay on as long as the temperature is at the set point or above. When the ambient temperature reaches the second set point (e.g., 600° F.), the second indicator will illuminate and will stay on as long as the temperature is at that set point or above. The second indicator can indicate that there is a very short time period before temperatures reach a point at which flashover could occur. At this point, the firefighter (or other personnel) should consider immediately leaving the area to avoid a life threatening situation. Since the set points can be predetermined, the first set point can be set at the face piece manufacturer's suggested temperature rating for the normal functioning of the face piece to serve as an equipment failure warning. As mentioned above, the temperature set points can be varied by reprogramming of the digital potentiometers to provide alerts as to other unsafe conditions.

Figure 5:
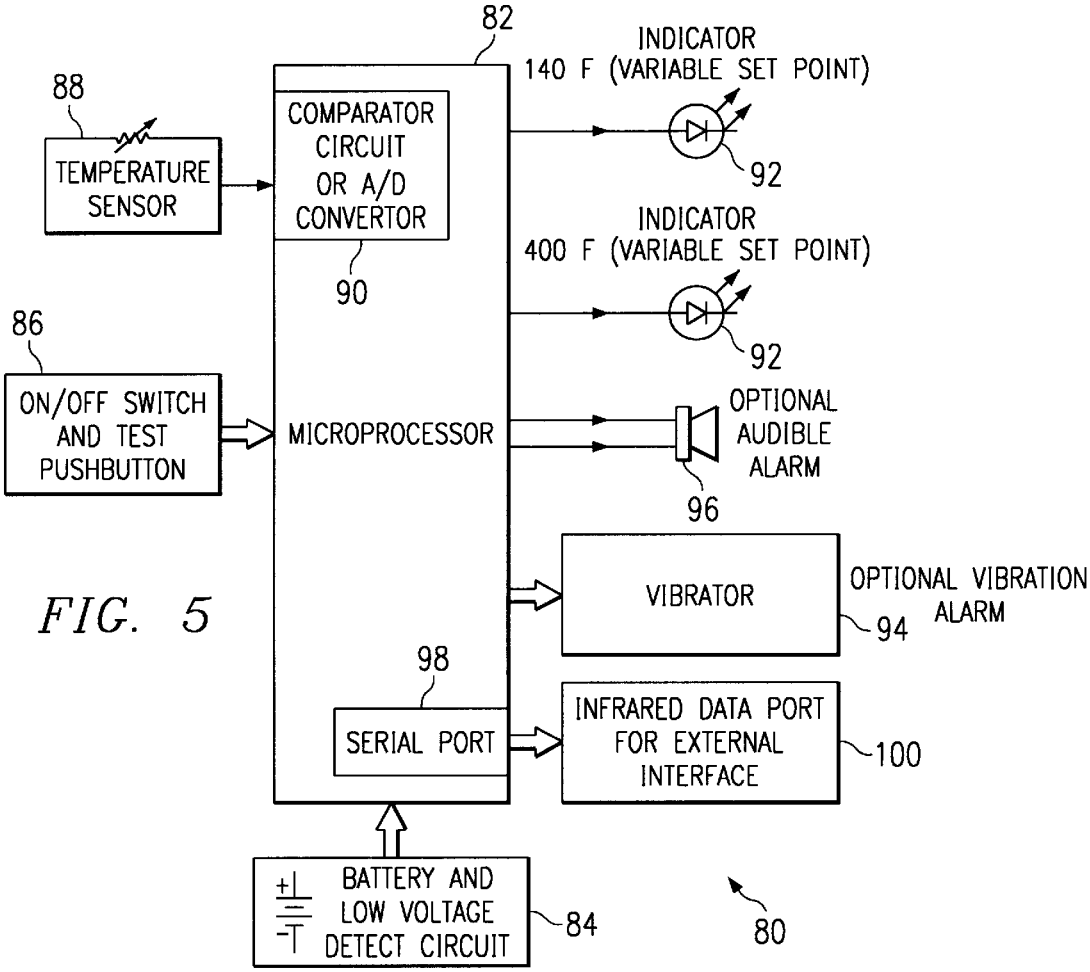
FIG. 5 is a block diagram of another embodiment of a system for alerting safety personnel of unsafe air temperature conditions.

FIG. 5 is a block diagram of another embodiment of a system, indicated generally at 80, for alerting safety personnel of unsafe air temperature conditions. As can be seen, system 80 is similar to system of FIG. 10 of FIG. 1. In the embodiment of FIG. 5, system 80 has a microprocessor 82 that receives power from a battery and low voltage detection circuit 84. Microprocessor 82 serves as a control unit for system 80, which could comprise alternate types of control devices as mentioned above. System 80 can be turned on and off by an on/off switch 86 which also can operate as a test push-button. A temperature sensor 88 measures temperature and provides an output to a comparator circuit or A/D converter 90 of microprocessor 82. Microprocessor 82 then provides signals to visible indicators 92 which have variable set points for indicating ambient temperature levels (e.g., 140° F. and 400° F.)

In operation, comparator circuit or A/D convertor 90 provides a signal to microprocessor 82 in response to a measurement by temperature sensor 88. Microprocessor 82 then provides signals to drive visible indicators 92. Further microprocessor 82 can provide signals to an optional vibration alarm 94 (e.g., mechanical motor, solenoid) and audible alarm 96. Further, microprocessor 82 comprises a serial port 98 which can output data to an infrared data port 100 for external interface to system 80. This could be user, for example, to recover a recorded temperature history or other pertinent information.

Figure 6A:
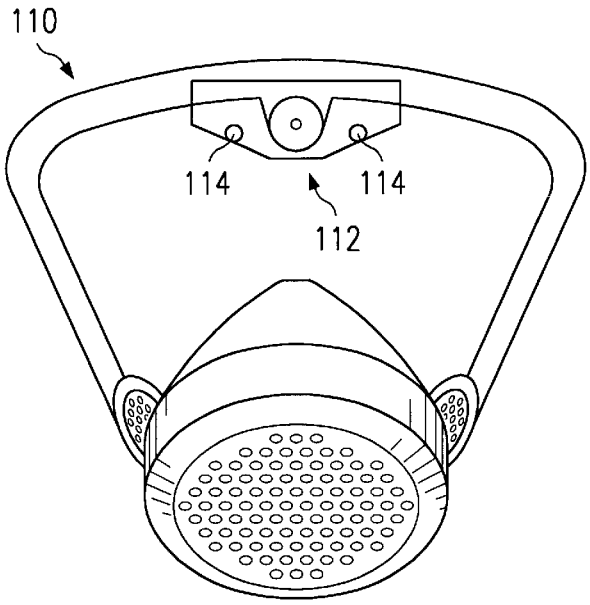
FIGS. 6A, 6B, 6C, 6D and 6E are diagrams of one embodiment of a through-screw sensor assembly for a system for alerting safety personnel of unsafe air temperature conditions constructed according to the present invention.
Figure 6B:
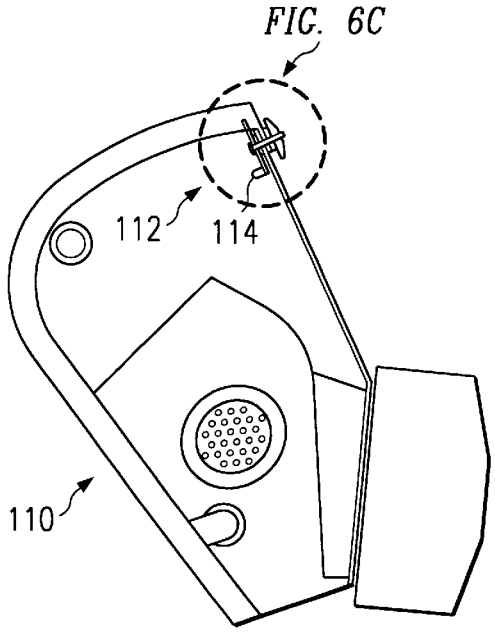

FIGS. 6A, 6B, 6C, 6D and 6E are diagrams of one embodiment of a through-screw sensor assembly for a system for alerting safety personnel of unsafe air temperature conditions constructed according to the present invention. As shown in FIG. 6A, a face mask 110 receives a through-screw sensor assembly, indicated generally at 112. Assembly 112 includes a pair of visible indicators 114 positioned within the range of vision of personnel wearing face mask 110. As can be seen, FIG. 6B is a side view of face mask 110. FIG. 6 also indicates an area shown in more detail in FIG. 6C.

Figure 6C:
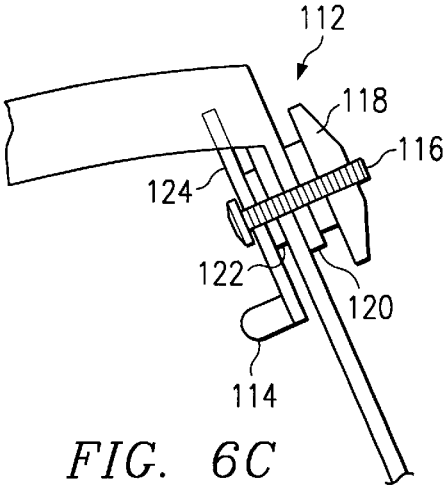
Figure 6E:
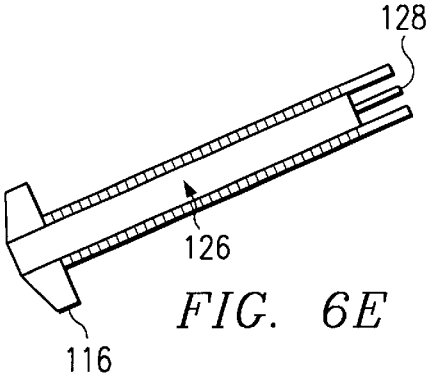
Figure 6D:
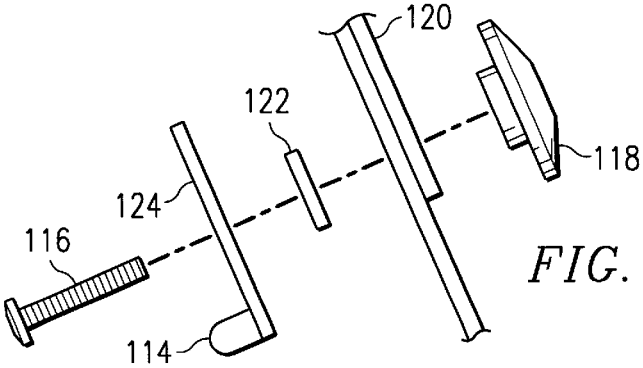

FIG. 6C provides a detailed view of assembly 112 affixed to face mask 110. As shown, assembly 112 comprises a hollow Allen head screw 116 which is coupled to face mask 110. Assembly 112 further comprises a nut 118 positioned outside a front portion 120 of face mask 110 and a washer 122 position inside front portion 120. Together, screw 116, nut 118 and washer 122 removably attach to front portion 120. Further, these components also hold a circuit board 124 to which indicators 114 are connected. FIG. 6D provides an explosion view of these same components of assembly 112. In addition, FIG. 6E provides a cross section diagram of screw 116. As shown, screw 116 has a hollow center 126 which can provide a connection to a resistive temperature device (RTD) 128.

Figure 7:
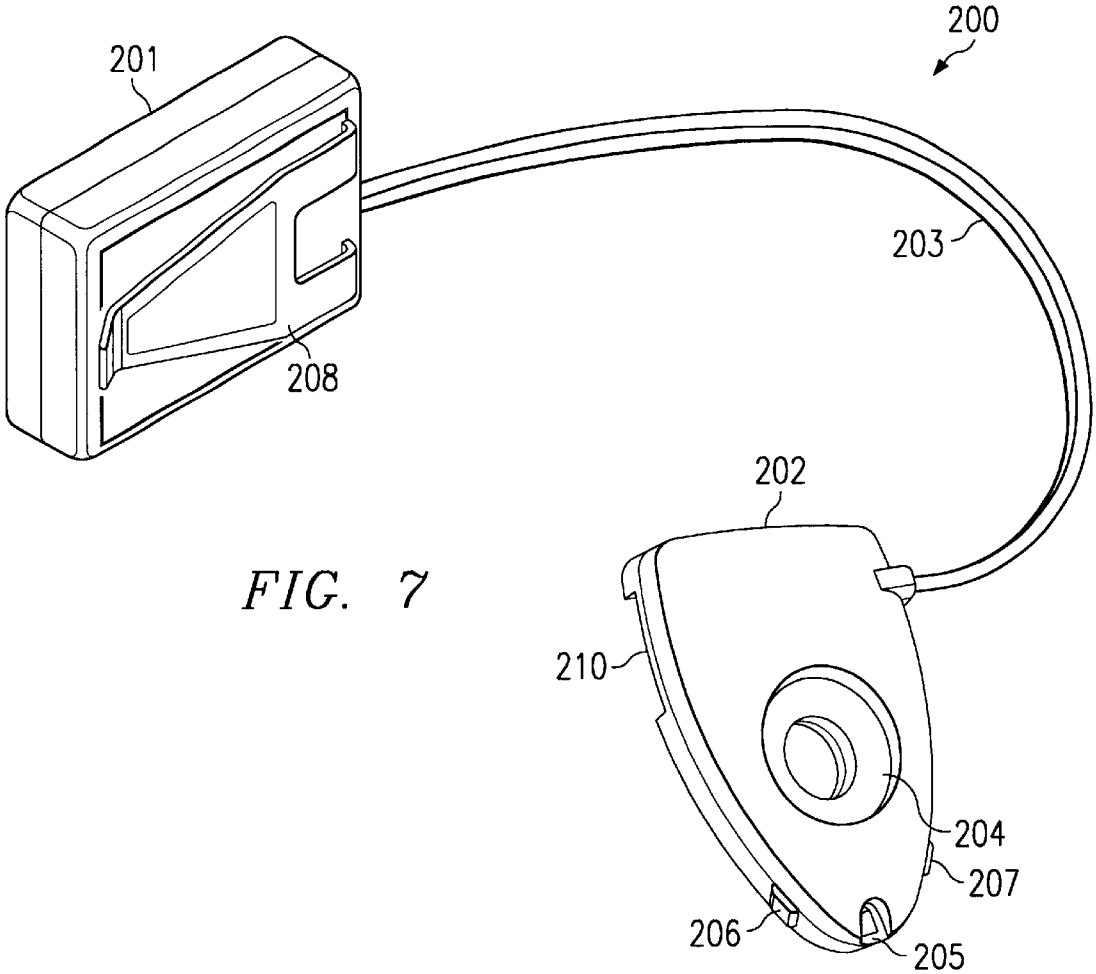
FIG. 7 illustrates a system for alerting safety personnel of unsafe air temperature conditions according to another embodiment present invention.

FIG. 7 illustrates a system for alerting safety personnel of unsafe air temperature conditions according to another embodiment of the present invention. The system, illustrated generally at 200, is an exemplary form of the system illustrated in FIGS. 6A, 6B, 6C, 6D and 6E. System 200, includes a sensor unit illustrated as sensor assembly 202 having a through-screw aperture 204 and a mounting channel 210 for mounting sensor assembly 202 to a safety personnel's safety gear such as a safety helmet, face piece or face mask, etc. Sensor assembly 202 further includes a first indicator 206, a second indicator 207 and a sensor 205 operable to sense temperature conditions within an ambient. In one embodiment, sensor assembly 202 may include waterproofing such as a high-temperature clear silicone plastic potting compound operable to withstand elevated temperatures while limiting exposure to water and other elements which may be encountered in a firefighting environment. Sensor assembly 202 is coupled via a cable 203 to housing 201 which includes a control unit and associated electronics for alerting safety personnel of air temperature conditions. Housing 201 further includes a clip 208 operable to be clipped to a safety personnel's safety gear such as a helmet, clothing, face mask webbing and the like. In one embodiment, housing 202 may be made of a waterproof material operable to withstand high temperatures while minimizing precipitant exposure of the electronics stored within housing 202. Housing 202 may include high-temperature silicon-rubber seals such as, for example, Viton® seals developed Dupont-Dow Elastomers, L.L.C., operable to withstand elevated temperatures while minimizing exposure to water and other elements.

Figure 8:
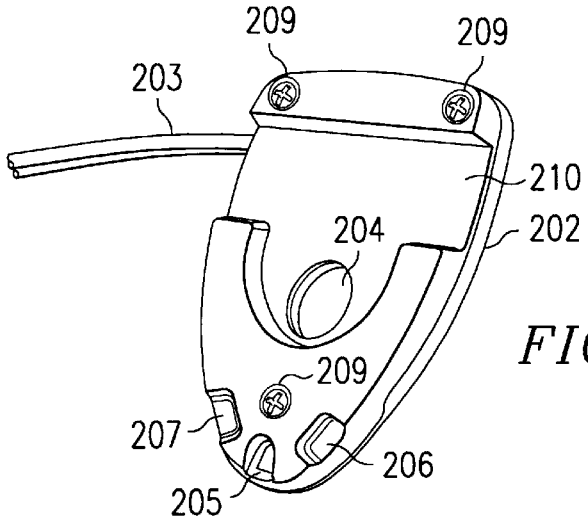
FIG. 8 is a rear perspective view of the sensor assembly illustrated in FIG. 7 according to the present invention.

In one embodiment, sensor 205 may include a thin element operable to be positioned within an opening or cavity associated with sensor 205. The thin element may include a front surface and a rear surface operable to be placed within an ambient environment. Sensor assembly 202 may include a cavity or opening at or near the tip or end of sensor assembly as illustrated in FIG. 7 and FIG. 8 below. As such, Sensor assembly 202 may provide an air flow path operable to allow ambient air to flow through the cavity and to exposed sensor 205 including the thin element. Sensor 205 may be positioned away from a mask or face shield (not shown) and within an ambient environment such that system 200 may consistently and accurately sense temperatures.

System 200 advantageously provides a safety alarm system that may be easily coupled or removed from safety equipment for ensuring the safety of personnel. FIG. 8 is a rear perspective view of the sensor assembly illustrated in FIG. 7. Sensor assembly 202 includes a plurality of screws 209 for coupling the front and rear surfaces of sensor assembly 202. Though not illustrated, front and rear surfaces may be realized as a one-piece molded unit which may not require screws to couple the front and rear surfaces of sensor assembly 202.

Through-screw aperture 204 and mounting channel 210 may be operable to mount sensor assembly 202 to a safety personnel's safety gear. Sensor assembly 202 also includes first indicator 206 and second indicator 207 operable to provide visible indications of temperature conditions detected by system 200.

In one embodiment, sensor assembly 202 may include rounded surfaces which may reduce snagging or jarring of sensor assembly 202 during use. Sensor assembly 202 may include a front surface made of a dark material and a rear surface made of an optically transmittable or substantially clear material which may include a micro-prism high-visibility surface finish to enhance visibility of indicators 206 and 207. Indicators 206 and 207 may also include optical transmission channels operable to transmit light to the outer surface of indicators 206 and 207 and sensor 205. In this manner, a user may view indicators 206 and 207 when illuminated, while other personnel proximal to the user may view an illuminated indicator via indicators 206 and 207 having optical transmission channels. For example, indicators 206 and 207 may be visible to other firefighters from the front of sensor assembly 202 by illuminating indicators 206 and 207 which include optical transmission channels or light conducting paths to outer portions of indicators 206 and 207 as illustrated in FIG. 7. As such, both the user and other personnel may view an indication representing a temperature condition.

During use, system 200 provides an advantageous system for alerting safety personnel of unsafe air temperature conditions. System 200, having a control unit within housing 201, includes electronics operable to communicate a signal associated with a detected temperature condition. Cable 203 may be communicatively coupled between sensor assembly 202 and housing 201. Sensor assembly 202 may be positioned within an ambient. In one embodiment, sensor 205 may be operable as "active" temperature sensor to provide continues monitoring of temperature conditions by sampling an ambient temperature on a periodic basis (e.g. every four seconds, eight records, etc.). In this manner, a detected ambient temperature condition may then be used to determine if an operating mode of system 200 should be altered. For example, system 200 may be operable to sample an ambient temperature condition every eight seconds and, upon detecting an ambient temperature condition the sample rate of the ambient temperature (e.g. increase sampling from eight seconds to four seconds). As such, system 200 may be operable to continuously monitor ambient temperature conditions while conserving energy of a power source, such as a battery, associated with system 200.

System 200 may be operable to provide a user an indication of ambient temperature conditions. For example, first indicator 206, operable as a green indicator, such as a miniature incandescent light, may be continuously illuminated during a safe temperature condition. Upon system 200 determining an unsafe ambient air temperature condition, control unit 201 may provide a signal to second indicator 206, operable as a red indicator, such as a miniature incandescent light, in response to a detected unsafe air temperature condition. For example, an unsafe air temperature condition may include sending a temperature of five hundred degrees Fahrenheit. As such, system 200 may be operable to continuously illuminate second indicator 206 operable as a red indicator.

Figure 9:
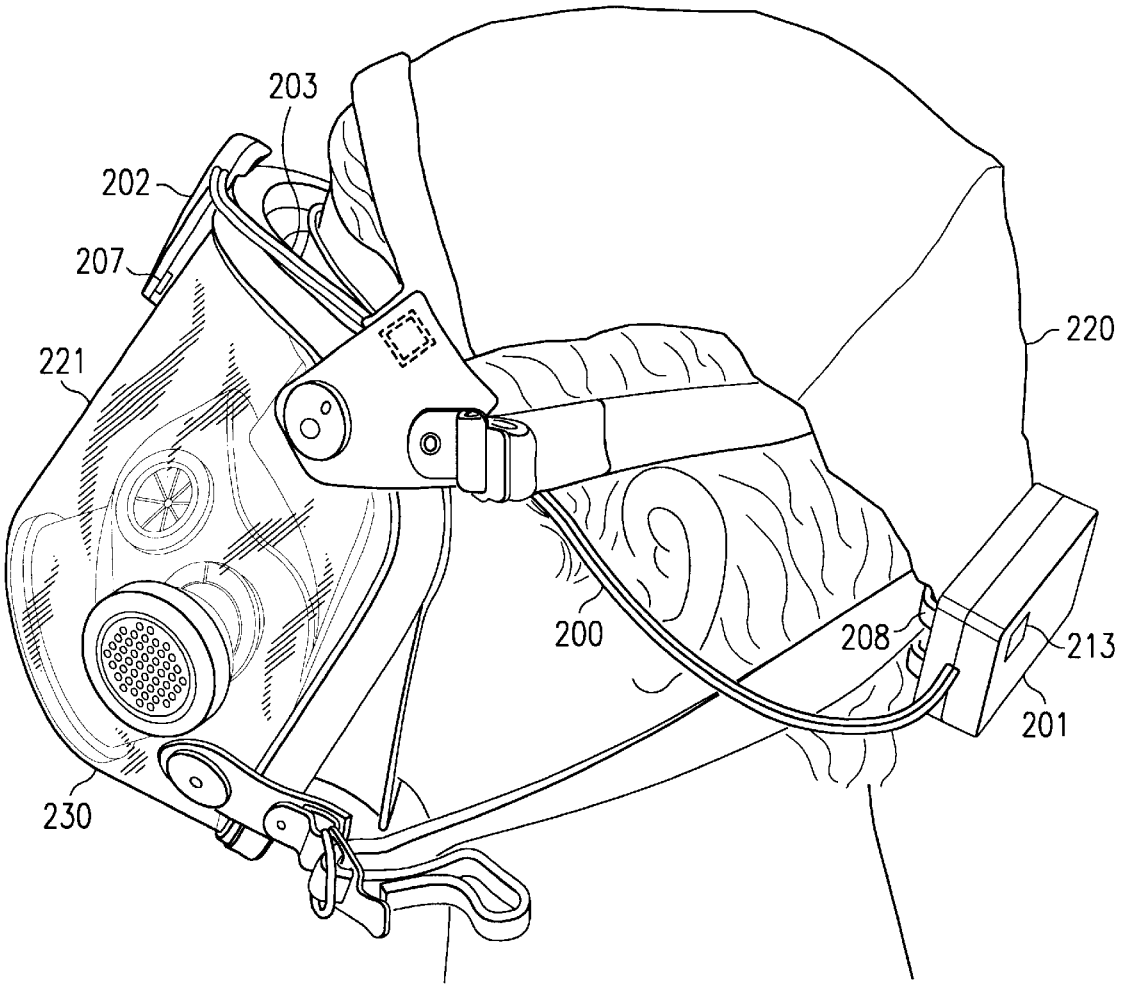
FIG. 9 is a lateral perspective view of the system of FIG. 7 coupled to a self contained breathing apparatus face piece according to one embodiment of the present invention.

FIG. 9 is a lateral perspective view of the system of FIG. 7 coupled to a self contained breathing apparatus face piece according to one embodiment of the present invention. System 200 may be coupled to a face mask 221 of a self contained breathing apparatus 230. Sensor assembly 202 may be coupled to a front portion of face mask 221 such that a user may view the indicators of sensor assembly 202. Housing 201 includes self test button 213 for checking the operating status of system 200 and may be operable to perform a battery test, determine a battery life, perform system diagnostics, etc. Housing 201 may be coupled to a face mask webbing 220 using clip 208 such that housing 206 may be covered by a helmet or other safety headgear (not shown). Housing 201 is coupled to sensor assembly 202 via cable 203 which may be positioned behind or along a portion of face mask 221 and face mask webbing 220. As stated above cable 203, sensor assembly 202 and housing 201 are preferably made of high quality materials capable of withstanding high temperature levels for extended periods of time (e.g. greater than five hundred degrees Fahrenheit for several minutes). System 200 advantageously allows for a user to position system 200 such that, during use, system 200 may be comfortably worn in addition to being easy to couple or remove as required. System 200 as illustrated provides an practical system which may be used with several different types of standard and existing safety equipment without having to be permanently mounted to safety equipment.

FIG. 10A is a front perspective view of the system of FIG. 7 coupled to a self contained breathing apparatus face piece according to one embodiment of the present invention. System 200 includes sensor unit 202 coupled to view mask 221 of self continual breathing apparatus 230 using face mask nut 222 and aperture 204 of sensor assembly 202. Sensor assembly 202 is coupled to control unit 201 (not shown) via cable 203, which may be positioned along an upper edge face mask 221 in a manner to reduce obscuring the view of a user. Sensor assembly 202 further includes first indicator 206, second indicator 207 and temperature sensor 205. In an exemplary embodiment, sensor assembly 202 may be substantially centered relative to view mask 221 thereby providing a safety system having indicators within constant peripheral vision of a user. As such, a user does not have to make an effort to monitor current ambient air temperature conditions while, for example, fighting a fire, performing a rescue, etc.

In one embodiment, a user may couple sensor unit 202 to view mask 221 such as a Scott AV-2000 face mask. As such, a user may remove face mask nut 222 from facemask 221 and position sensor assembly 202 substantially centered over the top-center of facemask 221. A user may then replace facemask nut 222 thereby coupling sensor assembly 202 to facemask 221. Cable 203 may then be routed along a top portion of facemask 221 such that cable 203 may not obscure the vision of a user.

Figure 10B:
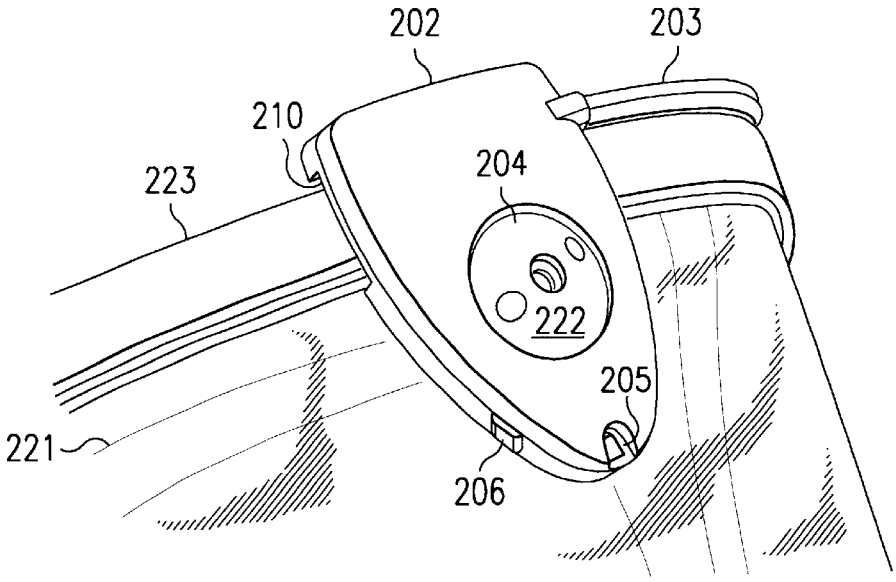
FIG. 10B is a lateral perspective view of the system of FIG. 7 coupled to a self contained breathing apparatus face piece according to one embodiment of the present invention.
Figure 10C:
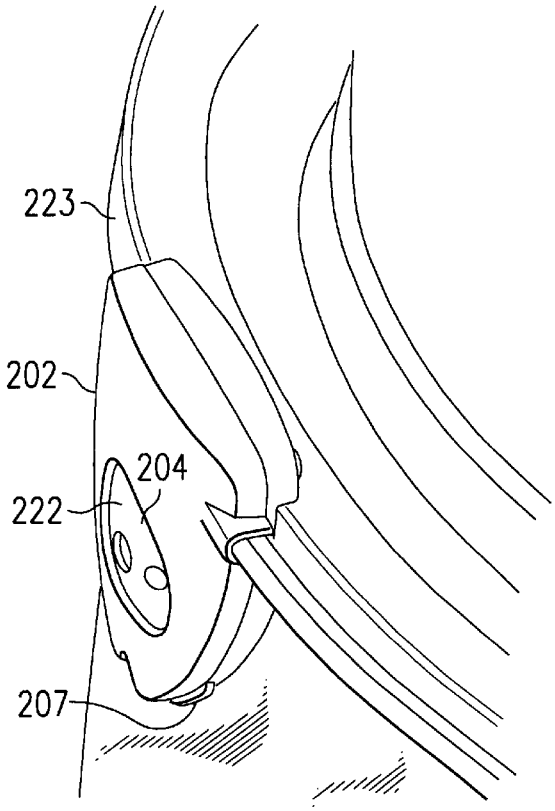
FIG. 10C is a top perspective view of the system of FIG. 7 coupled to a self contained breathing apparatus face piece according to one embodiment of the present invention.

FIG. 10B and 10C illustrate top and lateral perspective views of the system of FIG. 7 coupled to a self contained breathing apparatus face piece according to one embodiment of the present invention. Sensor assembly 202 of system 200 may be coupled to facemask 221 via facemask nut 222 and mounting channel 210 positioned about upper edge 223 of facemask 221. Sensor assembly 202 includes first indicator 206, second indicator 207 and sensor 205. Housing 201 (not shown) may be coupled to sensor assembly 202 via cable 203 positioned along upper edge 223 of facemask 221.

FIG. 11 is a flow chart of a method for alerting safety personnel of unsafe air temperature conditions according to another embodiment of the present invention. The method may be deployed by system 200 illustrated in FIGS. 1–7 or other systems operable to deploy the method illustrated in FIG. 11.

The method begins generally at step 300. At step 301 a temperature may be sensed using a temperature sensor such as a resistive temperature device (RTD), thermistor, infrared (IR) sensor, or other sensors operable to sense temperatures. Upon sensing a temperature, the method determines if the temperature is greater than one hundred forty degrees Fahrenheit. Although not limited to this value, the method may be used in association with firefighting systems wherein one hundred forty degrees is one example of a safe temperature level for firefighter personnel.

Upon determining if a temperature greater than one hundred forty degrees Fahrenheit, the method proceeds to step 303 where the method determines the level of the measured temperature. The present method, operable to determine temperature conditions, may provide several different types of indications depending on the determined conditions as they relate to, for example, safety procedures. For example, the method may be operable to determine a plurality of temperature levels or thresholds to provide various indications based upon the determined level. For example, one group of thresholds may include an ambient air temperature between one hundred forty degrees Fahrenheit and two hundred degrees Fahrenheit; an ambient air temperature above two hundred degrees Fahrenheit for a period of eight seconds; an ambient air temperature between four hundred degrees Fahrenheit and five hundred degrees Fahrenheit; an ambient air temperature above five hundred degrees Fahrenheit for eight seconds; or a plurality of other air ambient temperature conditions as needed.

Upon determining a level, the method proceeds to step 304 where the method may provide an appropriate indication for the determined level. For example, the method may determine an ambient air temperature condition of two hundred degrees Fahrenheit for a period of eight or more seconds. As such, the method may continuously illuminate indicator 206 which may be operable as a green light emitting diode or a miniature incandescent light. In another embodiment, an ambient air temperature condition between four hundred degrees Fahrenheit and five hundred degrees Fahrenheit may be determined. As such, first indicator 206 operable as a green Indicator may be continuously illuminated and second indicator 207 operable as a red Indicator may be periodically illuminated (e.g. blinking) thereby providing an overall indication reflective the determined level.

Upon providing an appropriate indication, the method proceeds to step 301 where the method senses a temperature. In this manner, the method provides for sensing an ambient air temperature, determining a level, and providing an appropriate indication based upon the sensed temperature to ensure that safety personnel have a current indication of the proximal ambient air temperature condition.

In one embodiment, a system deploying the method of FIG. 11 may be operable as an active system which may continuously sample an ambient temperature. As such, a system may be operable in an operating mode which may sense a temperature at a periodic rate based upon a determined temperature level. For example, a system may sense a temperature every eight seconds until a temperature level of one hundred degrees Fahrenheit's sensed. As such, the system may alter the operating mode to sense a temperature every four seconds. In this manner, the battery life of a battery associated with the system may be preserved during what may be "non-critical" temperatures thereby extending the amount of time a system may be used.

Figure 12:
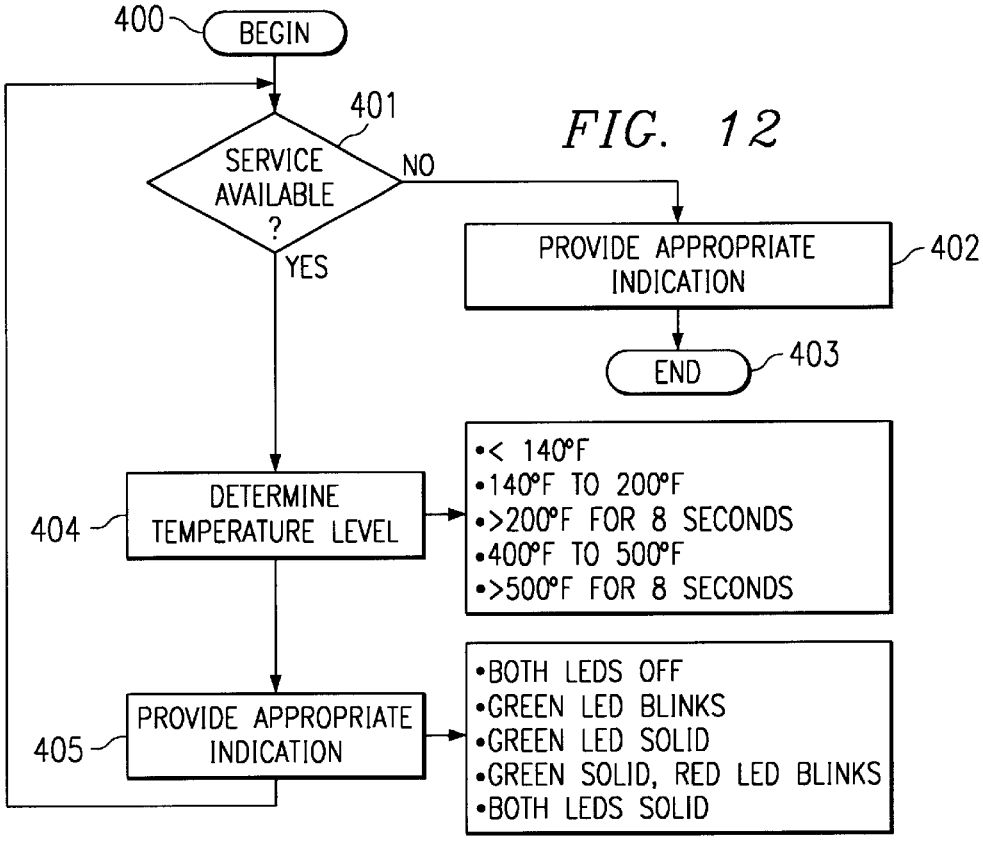
FIG. 12 is a flow chart of a method for activating a safety device for alerting safety personnel of unsafe air temperature conditions according to one embodiment of the present invention.

FIG. 12 is a flow chart of a method for activating a safety device for alerting safety personnel of unsafe air temperature conditions according to one embodiment of the present invention. The method may be deployed by system 200 illustrated in FIGS. 1-7 or other systems operable to deploy the method illustrated in FIG. 12. Reference numbers, components, and elements of system 2000 of FIG. 7 are used in an exemplary form and are not intended to limit the applicability of the method of FIG. 12 as described below.

The method begins generally at step 400. At step 401, the method determines if service is available for measuring ambient air temperature conditions utilizing a system such as system 200. For example, a voltage regulator associated with system 200 may determine the amount of power available for operating system 200. For example, a "power-consumption-to-operating-time" ratio may be provided for determining service availability. In one embodiment, fifteen minutes of service must be available prior to providing service for a system. If an appropriate amount of time is not available, the method may deny service and proceed to step 402 where an appropriate indication may be provided to a user. For example, both indicator 206 and second indicator 207 may blink three times indicating that service is not available due to a weak battery or power source.

In one embodiment, the method may perform a diagnostic check of a system prior to providing service. For example, the method may perform a system check of electronics and associated hardware prior to allowing service. One embodiment may also include a user initiating a system check or a battery test prior to using the system.

Upon determining that service is available, the method may then proceed to step 404 where the method determines a temperature level. For example, system 200 having sensor assembly 202 may sense a temperature using sensor 205. Upon sensing the temperature, a temperature level may then be determined based upon the sensed temperature. For example, an A/D converter may be used in association with sensor assembly 202. A converted signal representing the sensed temperature may then be used to determine the temperature level.

In one embodiment, several temperature levels or thresholds may be used to determine a temperature level. For example, one embodiment may include determining an ambient air temperature of one hundred forty degrees Fahrenheit; between one hundred forth degrees Fahrenheit and two hundred degrees Fahrenheit; greater than 200 degrees Fahrenheit for eight seconds; between four hundred degrees Fahrenheit and five hundred degrees Fahrenheit; and greater than five hundred degrees Fahrenheit for eight seconds. Other temperature levels or thresholds may be used in association with the method of FIG. 12 as desired.

Upon determining a temperature level, the method may proceed to step 405 where the method provides an appropriate indication for the determined level. For example, system 200 having first indicator 206 operable as a green Indicator and second indicator 207 operable as a red Indicator may be used to provide an appropriate indication of the determined temperature level of Step 404. As such, the method may use several combinations for illuminating first indicator 206 and second indicator 207. For example, the method may not illuminate either Indicator for a temperature of less than one hundred and forty degrees Fahrenheit; periodically illuminate (e.g. blinking) first indicator 206 for a temperature level between one hundred forty degrees Fahrenheit and two hundred degrees Fahrenheit; continuously illuminate first indicator 206 for a temperature level of greater than two hundred degrees Fahrenheit for eight seconds; continuously illuminate first indicator 206 and periodically illuminate (e.g. blinking) second indicator 207 for a temperature level between four hundred degrees Fahrenheit and five hundred degrees Fahrenheit; or continuously illuminate first indicator 206 and second indicator 207 for a temperature of greater than five hundred degrees Fahrenheit for eight seconds.

Upon providing an appropriate indication, the method proceeds to step 404 where the method determines another temperature level. In this manner, several different temperature levels and associated indications may be determined and provided by the method of FIG. 12 as needed or required while providing indications of ambient air current temperature conditions to safety personnel.

Figure 13:
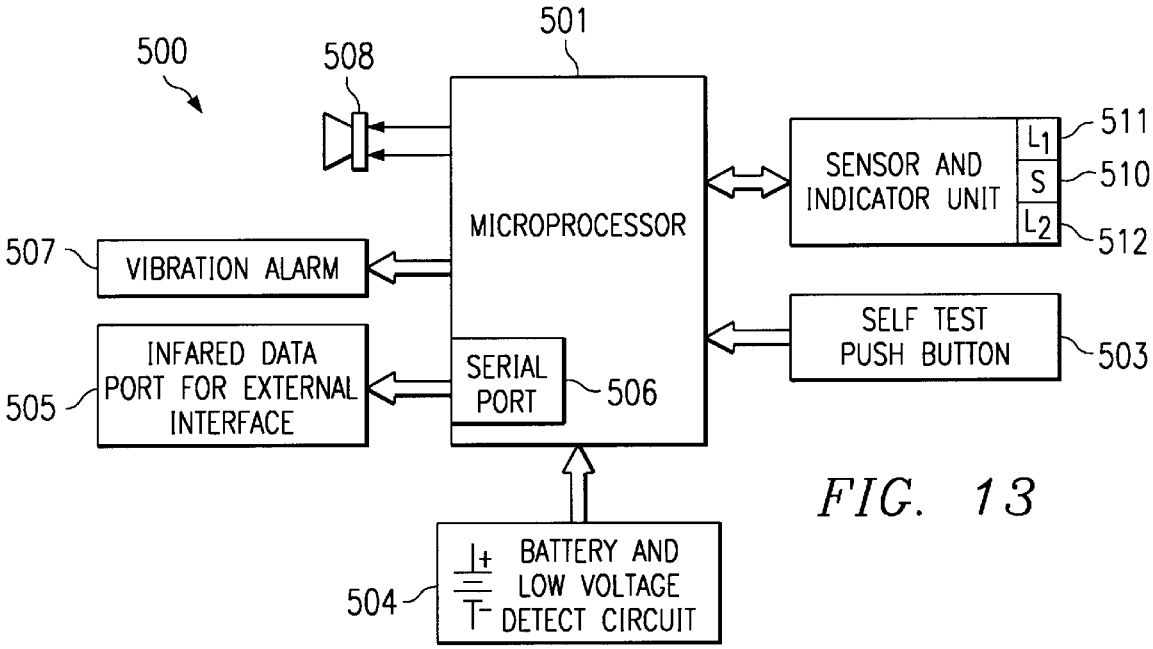
FIG. 13 is a block diagram of a system for alerting safety personnel of unsafe air temperature conditions according to another embodiment of the present invention.

10 FIG. 13 is a block diagram of a system for alerting safety personnel of unsafe air temperature conditions according to another embodiment of the present invention. As can be seen, system 500 is similar to system of FIG. 1 and system 80 of FIG. 5. In the embodiment of FIG. 13, system 500 includes a microprocessor 501 operable to receive power from a battery and low voltage detection circuit 504. In one embodiment, system 500 may provide a battery life of greater than four months at room temperature thereby reducing the need for replacing a battery on a frequent basis. Microprocessor 501 serves as a control unit for system 500, which may include alternate types of control devices as mentioned above. Service of system 500 be automatically determined by processor 501 or may also be determined by operating self test push-button 50*e*. Sensor unit 502 includes a first indicator 511, a second indicator 512 and a temperature sensor 510. Sensor unit 502 may be operable to measure temperature and may provide an output to a comparator circuit or A/D converter operably associated with microprocessor 501. Microprocessor 501 may also be operable to provide signals to first indicator 511 and second indicator 512.

System 500 may further include a vibration alarm 507 (e.g., mechanical motor, solenoid) and an audible alarm 508 operable to provide an indication based upon a determined temperature level. Further, microprocessor 501 may include a serial port 506 which operable to output data to an infrared data port 505 for external interface to system 500. As such, a recorded temperature history or other pertinent information may be obtained by an external device operable to communicate with system 500 via infrared data port 505.

During use, service or availability of system 500 may be determined by microprocessor 501 through accessing battery and low voltage detect circuit 504. Upon determining if sufficient voltage or battery life is available, system 500 may determine a temperature level using sensor unit 502 and sensor 510. Microprocessor 501 may determine an operating mode for system 500 by sampling an ambient air temperature using sensor unit 502 and providing an operating mode based upon a determined temperature. For example, system 500 may sample or sense a temperature every eight seconds for temperatures less than one hundred forty degrees Fahrenheit, and every four seconds for temperatures greater than one hundred forty degrees. As such, energy may be conserved at lower temperatures thereby extending the usable life of system 500's battery.

System 501, upon sensing a temperature with sensor unit 502, may then determine an ambient air temperature condition and provide an appropriate output. For example, if a temperature between one hundred forty degrees Fahrenheit and two hundred degrees Fahrenheit is determined, system 500 may provide one of a plurality of outputs available to system 500 such as using vibration alarm 507, audible alarm 508, indicators 511, 512. As such, system 500 provides an efficient system. for providing personnel an indication of current ambient air temperature conditions.

Although the present invention has been described in detail, it should be understood that various changes, substitutions and alterations can be made hereto without departing from the spirit and scope of the invention as defined by the appended claims.

What is claimed is:

1. A system for alerting safety personnel of ambient air temperature conditions, comprising:

a control unit stored within a housing, the control unit including electronics operable to communicate a signal associated with an ambient air temperature condition;

a sensor unit communicatively coupled to the control unit, the sensor unit operable to be positioned within an ambient environment at a distance from the control unit;

the sensor unit including a temperature sensor operable to sense an ambient air temperature condition and an indicator operable to provide an indication when the ambient air temperature condition indicates imminent flashover and temperature set points related to personnel safety;

means for removably coupling the sensor unit with an external portion of a self contained breathing apparatus face mask;

means for removably coupling the control unit with a safety personnel's safety gear; and wherein the means for removably coupling the sensor unit with an external portion of a self contained breathing apparatus face mask comprises:

a face mask nut; and an aperture in the sensor unit cooperating with the face mask nut for removably coupling the sensor unit with the external portion of the self contained breathing apparatus face mask.

2. The system of claim 1 wherein the sensor unit further comprises a first indicator, a second indicator and the temperature sensor.

3. The system of claim 1 further comprising a single screw attachment mechanism providing a portion of the means for removably coupling the sensor unit with the face mask.

4. The system of claim 1 wherein the sensor unit further comprising optical transmission channels to allow other safety personnel to view the indicators.

5. The system of claim 1 further comprising an idle mode of operation, an active mode of operation and a continuous mode of operation with each mode of operation based on the ambient temperature condition.

6. The system of claim 1 further comprising the temperature sensor and the indicator integrated into a single member.

7. The system of claim 1 further comprising an optical channel formed in the sensor unit to transmit light.

8. A two unit system for alerting safety personnel of ambient air temperature conditions, comprising:

a control unit stored within a housing, the control unit including electronics operable to communicate a signal associated with an ambient air temperature condition;

a sensor unit communicatively coupled to the control unit, the sensor unit operable to be positioned within an ambient environment at a distance from the control unit;

the sensor unit having a temperature sensor operable to sense an ambient air temperature and an indicator operable to provide a visual indication representing the ambient air temperature condition; and wherein the control unit is operable to electronically record a history of sensor data regarding ambient air temperature conditions.

9. The system of claim 8 wherein the sensor unit and the indicator form an integrated unit operable to be coupled to an external portion of a view mask.

10. The system of claim 8 further comprising the control unit operable to continuously monitor the connections to the sensor unit for short-circuit and open-circuit failures.

11. The system of claim 8 further comprising the sensor unit operable to warn safety personnel of short-circuit and open-circuit failures regarding the sensor.

12. The system of claim 8 further comprising the sensor unit operable to provide respective visual indications corresponding with a plurality of different ambient temperature conditions.

* * * * *